United States Patent [19]

Hirano et al.

[11] Patent Number: 4,526,712

[45] Date of Patent: Jul. 2, 1985

[54] PROCESS FOR TREATING RADIOACTIVE WASTE

[75] Inventors: Mikio Hirano; Susumu Horiuchi, both of Hitachi, Japan

[73] Assignee: Hitachi, Ltd., Tokyo, Japan

[21] Appl. No.: 107,918

[22] Filed: Dec. 28, 1979

[30] Foreign Application Priority Data

Jan. 12, 1979 [JP] Japan ..... 54-2758

[51] Int. Cl.[3] ..... G21F 9/14

[52] U.S. Cl. ..... 252/632; 264/0.5; 110/237

[58] Field of Search ..... 252/301.1 W, 632; 110/237; 264/0.5

[56] References Cited

U.S. PATENT DOCUMENTS 4,053,432 10/1977 Tiepel ..... 252/301.1 W

FOREIGN PATENT DOCUMENTS 762431 2/1970 Belgium ..... 252/301.1 W 2851231 5/1979 Fed. Rep. of Germany ... 252/301.1 W 2907984 9/1979 Fed. Rep. of Germany ... 252/301.1 W 52-94866 8/1977 Japan ..... 252/301.1 W

*Primary Examiner*—Deborah L. Kyle

*Attorney, Agent, or Firm*—Antonelli, Terry & Wands

[57] ABSTRACT

A process for treating radioactive sludge waste wasted in a nuclear power plant comprises the steps of pulverizing the radioactive sludge waste into dry powder which is combustible, burning the powder into ashes, and pelletizing the ashes. The radioactive sludge waste including granular ion-exchange resins, powder resins, filter sludge, etc. is reduced in volume by subjecting to combustion.

6 Claims, 3 Drawing Figures

PROCESS FOR TREATING RADIOACTIVE WASTE

BACKGROUND OF THE INVENTION

This invention relates to a process for treating a radioactive waste, and more particularly to a process for treating a radioactive sludge waste suitable for reducing greatly in volume the waste such as radioactive sludge discharged from a nuclear power plant.

In a nuclear power plant, granular ion-exchange resins mainly used for purifying a condensate, powder resins of filter aids mainly used for purifying a reactor water, filter sludge of filter aids comprising mainly cellulose used in a radioactive waste treatment system, etc. are wasted as so-called radioactive sludge waste. Since such a radioactive sludge waste has radioactivity, it is stored in a slurry state in storage tanks, or in a state caked with cement in drums.

Storage of such a radioactive sludge waste in the slurry state causes serious problems such as corrosion of storage tank walls, etc., thereby making it difficult to store the radioactive sludge waste for a long time. Further, tanks of large capacity are required for storing the radioactive sludge waste. In storage of the radioactive sludge waste in the cemented state, a large number of drums are required for the storage because in order to obtain strength necessary to keep the cemented state or caked state an amount of the radioactive sludge waste to be mixed with cement is limited. For example, in a drum with capacity of 200 l, only 10~20 kg of the radioactive sludge waste which is about 30 l in volume can be filled, which means that the radioactive sludge waste of 30 l becomes a waste of 200 l.

In order to reduce the volume of the radioactive sludge waste, various treatments therefor are tried, one of which is to burn up used granular resins and power resins, however these include a lot of water even after being subjected to centrifugal separation, so that complete combustion of the resins can not be effected. Another treatment for reducing the radioactive sludge waste is to make it powder and form the powder into pellets, which is described in Japanese Laying-open of Patent Application No. 52-94866 (1977). In this treatment, only about 150 kg of the radioactive waste can be filled in a drum of the capacity of 200 l. The reduction in volume is not enough. Therefore, a great reduction of the radioactive sludge waste in volume is desired strongly.

SUMMARY OF THE INVENTION

An object of the invention is to provide a process for treating a radioactive waste, wherein its volume is reduced greatly.

Another object of the invention is to provide a process for treating a radioactive sludge waste, in which the radioactive sludge waste is reduced in volume effectively and greatly, and converted to a material which is easy in handling.

Briefly stated, a feature of the invention comprises the steps of pulverizing a radioactive waste in a slurry state such as radioactive granular ion-exchange resins powder resins, filter sludge, etc. into dry powder which is combustible, burning the dry powder into ashes, and forming the ashes in blocklike articles which are easy to handle, such as pellets.

By converting the radioactive waste in slurry into ashes through pulverizing and burning, the radioactive waste is reduced in volume greatly. Further, the ashes are converted into pellets which are easy to handle by pelletizing.

DESCRIPTION OF THE PREFERRED EMBODIMENT

Figure 1:
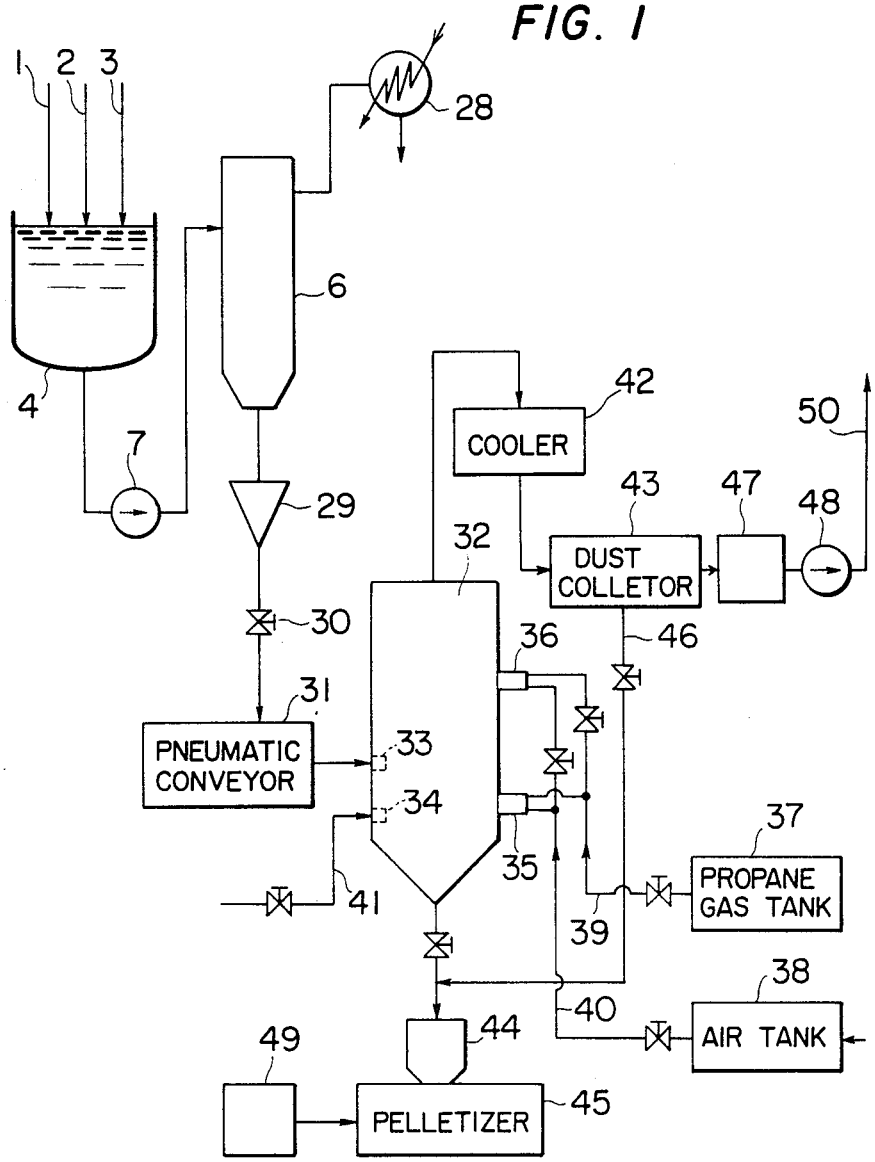
FIG. 1 is a schematic view of an apparatus for carrying out an embodiment of a process for treating a radioactive waste according to the invention.
Figure 2:
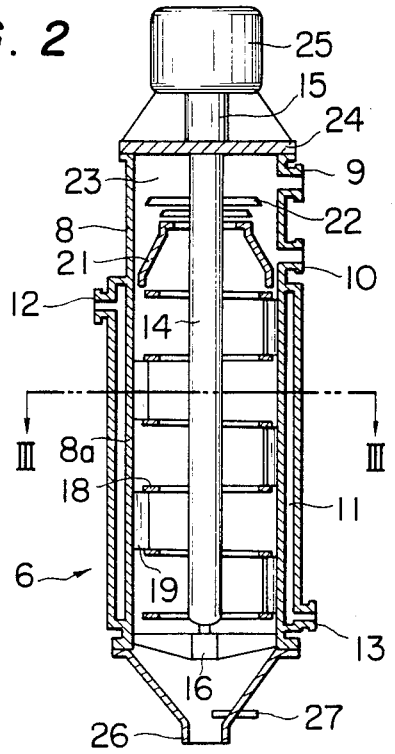
FIG. 2 is a sectional view of a thin film drier which is applied in the apparatus shown in FIG. 1.
Figure 3:
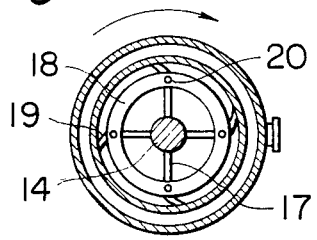
FIG. 3 is a sectional view taken along a line III—III of FIG. 2.

Referring to FIGS. 1 to 3, an embodiment of a process for treating radioactive waste according to the invention will be described hereinafter in detail.

In FIG. 1, a radioactive waste such as granular ion-exchange resins 1 used for purifying mainly condensate, powder resins 2 used as filter aids for purifying reactor water, and filter sludge 3, the main component of which is cellulose used as filter aids for a radioactive waste treatment system are collected and stored in a storage tank 4. In order to pulverize the stored waste, the waste is transported to a thin film drier 6 by a feed pump 7 which can control an amount of the waste in slurry to be transported.

The structure of the thin film drier 6 is shown in FIGS. 2 and 3. In FIG. 2, a shell 8 of the thin film drier 6 is cylindrical and provided with a vapour outlet 9 and a feed inlet 10 at the upper portion. The shell 8 further has a heat conduction wall **8*a* surrounded by a jacket 11 formed outside the shell 8. The jacket 11 is provided with an inlet 12 and an outlet 13 for heating medium such as steam. In the outside of the shell 8, a rotary shaft 14 is disposed which is rotatably supported by an upper bearing 15 and a lower bearing 16. As shown in FIG. 3, the rotary shaft 14 has a plurality of supporting arms 17 each joined to the shaft 14 and extending radially. The supporting arms 17 support rings 18. Blades 19 each are disposed between the rings 18, swingably connected to the rings 18 by pins 20, and contacted with the wall 8*a* of the shell 8 when the rotary shaft 14 is rotated by a driving device such as a motor 25. Over the most upper supporting ring 18, a distributor 21 is disposed for distributing the waste from the feed inlet 10 over the wall 8*a* of the shell 8. Over the separator 21, a mist separator 22 is disposed. The mist separator 21 defines a vapor compartment 23 thereabove in cooperation with a rid 24 secured to the shell 8**.

The radioactive waste in slurry state, transported from the storage tank 4 enters the thin film drier 6 at the feed inlet 10. The entered wastes are dispersed uniformly by the distributor 21 toward the wall **8*a* of the shell 8 which is heated to a temperature above 100° C, preferably of 120°~160° C. by steam entered at the inlet 12 and gone out from the outlet 13. The waste falling along the wall 8*a* is pressed on the wall 8*a* by the blades 19 on which centrifugal force is applied by the rotation of the rotary shaft 14 in a direction shown by an arrow to form thin films. The thin films receive heat from the wall 8*a* of the shell 8, so that the waste will be ground into powder until the waste reaches about an outlet 26. The temperature of the powder at the outlet 26 is detected by a thermometer 27 and an amount of the waste entering at the feed inlet is regulated by the feed pump 7 so that the powder will be dried substantially, preferably the temperature of the powder about the outlet 26 will be about 100°~130° C. The powder in the outlet 28 has moisture content of less than about 2~3% and an average particle size of about 10μ. The thermometer 27** is used mainly for watching disorder of the apparatus in a usual operation.

In order to detect the moisture content of the powder discharged from the outlet 26, a moisture detector may be used for the thermometer 27.

Vapour, generated by drying the thin film waste or powder rises upward and mist mixed with the vapour is separated by the mist separator 22 so that only vapour enters the vapour compartment 23. The vapour is transferred to a condensor 28 provided out of the thin film drier 6 and condensed thereby to water.

The powder formed by the thin film drier 6 is transported to a hopper 29 with a valve 30.

The powder, disposed in the hopper 29 is transported to a combustion furnace 32 by air transport using a pneumatic conveyor 31, with the valve 30 being opened. The combustion furnace 32 is provided with a powder supply nozzle 33, an air nozzle 34, a first burner 35, and a second burner 36. The first and second burners 35, 36 each are connected with a propane gas tank 37 and an air tank 38 through pipes 39, 40 with valves. The burner 35 provides flames in the combustion furnace 32. The powder from the pneumatic conveyor 31, mixed with air for transport is fed into the combustion furnace 32 by the nozzle 33. The second burner 36 provides secondary combustion region in the upper portion of the combustion furnace in case where the powder does not burn completely. Where the air, mixed with the powder by the pneumatic conveyor 31 is not substantial for effecting complete combustion of the powder fed, supplemental air is supplied into the combustion furnace 32 through the nozzle 33 connected to an air supply duct 41. Combustion gas from the furnace 32 is cooled by a cooler 42, and transported to a dust collector 43 which is provided therein with celemics filters. Dusts collected by the dust collector 43, that is, mainly ashes are transported to a hopper 44 provided on a pelletizer 45 through a pipe 46 with a valve. The combustion gas passing through the dust collector 43 is further subjected to filteration by a high efficiency particle air filter 47, whereby radioactive dusts or ashes are completely removed. The combustion gas cleaned is exhausted to atmosphere from a stack 50 by a blower 48.

The wastes such as the granular ion-exchange resins, powder resins, cellulose, etc. are reduced to 1/200~1/500 in volume by burning them.

The ashes stored in the bottom of the combustion furnace 32 are collected in the hopper 44 together with the ashes from the dust collector 43, and fed into the pelletizer 45 to be formed in pellets, with binder being fed from a tank 49.

In a case where the filter sludge is made into the powder, the powder corresponding to 20~30% of the ashes in weight may be used for the binder.

The ashes can be stored as they are, however the pellets of the ashes can be stored with more safety than stored in a state of the ashes, and has a reduction ratio of ½ as compared with a state of the ashes.

In this embodiment, for the transport of the powder made by the thin film drier 6, air is used, and the air used for the transportation is used also as burning air. Therefore, the powder and the air are mixed enough well, and spread out substantially in the combustion furnace 32. The air transport of the powder serves greatly for complete combustion of the powder.

According to this embodiment of the process for treating waste, a reduction ratio in volume is very large, that is, in the case of the granular resins, the waste to be discarded is reduced to about 1/30 in volume as compared with a conventional cement-solidfying method; in the case of the powder resins, about 1/600 in volume; and in the case of the filter sludge, about 1/3000 in volume. The process can continously treat the waste with a simple apparatus and a simple operation. Various kinds of wastes can be mixed at any ratio, and treated at the same time and by the same apparatus. The waste is shaped in pellet so that their handling is easy, and the pellet can be stored stably for a prolonged period of time. Furthermore, in future, even if what type of final state of waste to be discarded will be taken, the pellets can be adapted for the final state in future. Still further, when a solidifying treatment of the pellets is done after the ashes are made into pellets, stored and subjected to falling into decay, there is advantages such that a surface does rate can be reduced, and such that after a final state in which the radioactive waste will be discarded is determined, the solidifying treatment of the pellets can be carried out.

What is claimed is:

1. A process for treating radioactive sludge waste comprising the steps of:

pulverizing radioactive sludge waste which is wet, insoluble and combustible, while heating the radioactive sludge waste to make a dry powder suitable for combustion, said step of pulverizing the radioactive sludge waste including the steps of making thin films of the radioactive sludge waste during grinding of the waste into powder, and heating the thin films and the powder to vaporize the water contained in the powder;

burning the dry powder by dispersing the powder over flames to form ashes and to reduce the volume of the radioactive waste while exhausting combustion gas from the zone of combustion;

collecting the ashes; and pelletizing the ashes to form pellets having a volume substantially less than the volume of the ashes.

2. The process as defined in claim 1, wherein the step of pulverizing the radioactive sludge waste is effected using a thin film drier provided with a heat conduction face and a rotor with a plurality of moving blades for pressing the radioactive sludge waste on the heat conduction face to make thin films and grind the waste into powder while heating by the heat conduction face.

3. The process as defined in claim 5, wherein the radioactive sludge waste is radioactive sludge waste obtained from in a nuclear power plant, and the water content of the dry powder formed of the radioactive sludge waste is less than 3%.

4. A process for treating radioactive sludge waste obtained from nuclear power plants, comprising the steps of:

storing various kinds of radioactive sludge waste in a storage tank;

feeding the radioactive sludge waste from the storage tank to a thin film drier;

making thin films of the radioactive sludge waste and grinding the waste into powder within said thin film drier;

heating the thin films and the powder by contacting the waste with a heat conduction wall heated to a temperature above 100° C. within the drier to remove water therefrom;

air transporting the powder to a combustion furnace by a pneumatic conveyor;

burning the powder to form ashes by dispersing the powder over flames generated in the combustion furnace along with air used for transporting the powder;

separating the resulting ashes from a combustion gas generated in the burning of the powder;

collecting the ashes separated and the ashes discharged from the combustion furnace;

purifying and exhausting the combustion gas to the atmosphere; and pelletizing the ashes collected to form pellets having a volume substantially less than the volume of said ashes.

5. The process as defined in claim 4, wherein the powder has an average particle diameter of 10$\mu$, and the water content less than 3% by weight.

6. The process as defined in claim 1 or in claim 4, wherein the volume of the ashes is reduced to one-half during the formation of the pellets by pelletizing.

* * * * *